US006546904B2

(12) United States Patent
Marchioni et al.

(10) Patent No.: US 6,546,904 B2
(45) Date of Patent: Apr. 15, 2003

(54) ELECTROMAGNETIC ACTUATOR FOR THE ACTUATION OF THE VALVES OF AN INTERNAL COMBUSTION ENGINE WITH RECOVERY OF MECHANICAL PLAY

(75) Inventors: Massimo Marchioni, Bologna (IT); Nicola Morelli, Rende (IT)

(73) Assignee: Magnetic Marelli S.p.A., Milan (IT)

( * ) Notice: Subject to any disclaimer, the term of this patent is extended or adjusted under 35 U.S.C. 154(b) by 0 days.

(21) Appl. No.: 09/800,790

(22) Filed: Mar. 7, 2001

(65) Prior Publication Data

US 2001/0037778 A1 Nov. 8, 2001

(30) Foreign Application Priority Data

Mar. 9, 2000 (IT) ..... BO200A127

(51) Int. Cl.[7] ..... F01L 9/04

(52) U.S. Cl. ..... 123/90.11; 310/12; 123/90.52; 123/90.46

(58) Field of Search ..... 310/12; 123/90.11, 123/90.62, 90.53, 90.55, 90.46

(56) References Cited

U.S. PATENT DOCUMENTS 5,762,035 A 6/1998 Schiebitz ..... 123/90.11

6,262,498 B1 * 7/2001 Leiber ..... 310/12

FOREIGN PATENT DOCUMENTS

| | | |
|---|---|---|
| DE | 197 02 458 | 9/1997 |
| DE | 196 28 860 | 1/1998 |
| DE | 199 28 006 | 12/2000 |

* cited by examiner

*Primary Examiner*—Thomas Denion
*Assistant Examiner*—Jaime Corrigan
(74) *Attorney, Agent, or Firm*—Baker & Daniels

(57) ABSTRACT

An electromagnetic actuator for intake or exhaust valves of an internal combustion engine, in which an oscillating arm has an end in abutment on the upper end of the stem of the intake or exhaust valve; two electromagnets being provided to move the oscillating arm so as axially to displace this valve; a frame supporting the arm being connected to the head of the engine so as to be able to oscillate about an axis perpendicular to the axis of movement of the intake or exhaust valve and the electromagnetic actuator being provided with a device for adjusting the position of the frame with respect to the head to rotate the frame so as to maintain the mechanical play between the end of the oscillating arm and the stem of the valve at a predetermined value.

14 Claims, 5 Drawing Sheets

ELECTROMAGNETIC ACTUATOR FOR THE ACTUATION OF THE VALVES OF AN INTERNAL COMBUSTION ENGINE WITH RECOVERY OF MECHANICAL PLAY

The present invention relates to an electromagnetic actuator for the actuation of the valves of an internal combustion engine.

BACKGROUND OF THE INVENTION

As is known, internal combustion engines are currently being tested in which the intake and exhaust valves that selectively bring the combustion chamber of the engine into communication with the intake manifold and respectively with the exhaust manifold of the engine are actuated by electromagnetic actuators driven by an electronic control unit. This solution makes it possible to vary, in a very precise manner, the lift, opening time, and opening and closing moments of the valves as a function of the angular speed of the crankshaft and of other operating parameters of the engine, substantially increasing the performance of the engine.

The electromagnetic actuator that currently provides the best performance is disposed alongside the stem of the valve of the internal combustion engine to be axially moved and comprises a support frame rigid with the head of the internal combustion engine, an oscillating arm of ferromagnetic material having a first end hinged on the support frame in order to be able to oscillate about an axis of rotation perpendicular to the longitudinal axis of the valve, and a second cam-shaped end disposed in abutment on the upper end of the stem of the valve, and a pair of electromagnets disposed on opposite sides of the central portion of the oscillating arm in order to be able to attract, on command and alternatively, the oscillating arm by causing it to rotate about its axis of rotation.

Each electromagnet is normally formed by a magnetic core formed by a pack of sheets clamped between two lateral metal plates forming part of the support frame and by a coil of electrically conducting material keyed on the magnetic core.

The electromagnetic actuator lastly comprises two elastic members, the first of which is adapted to maintain the valve of the engine in a closed position and the second of which is adapted to maintain the oscillating arm in a position such as to maintain this valve in the position of maximum opening. The two elastic members act in opposition against one another and are dimensioned such as to position, when neither of the electromagnets are being supplied, i.e. they are in a condition of equilibrium, the oscillating arm in a rest position in which it is substantially equidistant from the polar heads of the two electromagnets so as to maintain the valve of the engine in an intermediate position between the closed position and the position of maximum opening.

The main drawback of the electromagnetic actuator described above is that there is mechanical play between the cam-shaped end of the oscillating arm and the upper end of the stem of the valve which varies substantially as a function of the operating temperature of the actuator, thereby ruling out some of the advantages deriving from the use of such an electromagnetic actuator. The lift of the valve, the opening time and the moments of opening and closing of the valves in practice vary substantially as a function of the mechanical play between the cam-shaped end of the oscillating arm and the upper end of the stem of the valve, substantially reducing the actuation precision that can be obtained when using the above- mentioned electromagnetic actuator.

In the electromagnetic actuator described above it is also very important for the packs of sheets of each electromagnet always to maintain their optimum predetermined position in which the air gaps between the sheets are reduced to a minimum. This is necessary because the consumption of electrical energy by the two electromagnets has to be minimised, and in practice the greater the air gaps of the magnetic circuit, the greater the magnetising currents that have to circulate in the electromagnets and therefore, the greater the power used and the power dissipated by these electromagnets. Reducing the air gaps to a minimum requires highly accurate assembly of the components of the magnetic circuit (substantially the electromagnets and the oscillating arm) and this assembly precision has to be maintained over time during the normal operation of the actuator, and therefore any variations of the optimum position of the packs of sheets (due to displacements and/or deformations of the plates as a result of mechanical stresses) may readily entail an overall increase of the air gaps.

SUMMARY OF THE INVENTION

The object of the present invention is to provide an electromagnetic actuator for the actuation of the valves of an internal combustion engine that makes it possible to recover the mechanical play and that, at the same time, makes it possible to maintain the packs of sheets forming the magnetic core of each electromagnet in the above-mentioned predetermined optimum position.

The present invention therefore relates to an electromagnetic actuator for the actuation of the valves of an internal combustion engine that comprises a head, at least one variable- volume combustion chamber, at least one connection duct adapted to bring the combustion chamber into communication with atmosphere, and at least one valve adapted to regulate the passage of fluids to and from the combustion chamber, the valve being mounted in the head such that it can move axially between a closed position in which it closes off the connection duct and a position of maximum opening in which it enables fluids to pass through the connection duct with the maximum admissible flow, the electromagnetic actuator being mounted on the head in order to move the valve, on command, between its closed position and its position of maximum opening and being characterised in that it comprises means for recovering the mechanical play existing between the valve and the actuator.

BRIEF DESCRIPTION OF THE DRAWINGS

The present invention will now be described with reference to the accompanying drawings, which show a non-limiting embodiment thereof and in which.

DETAILED DESCRIPTION OF THE INVENTION

Figure 1:
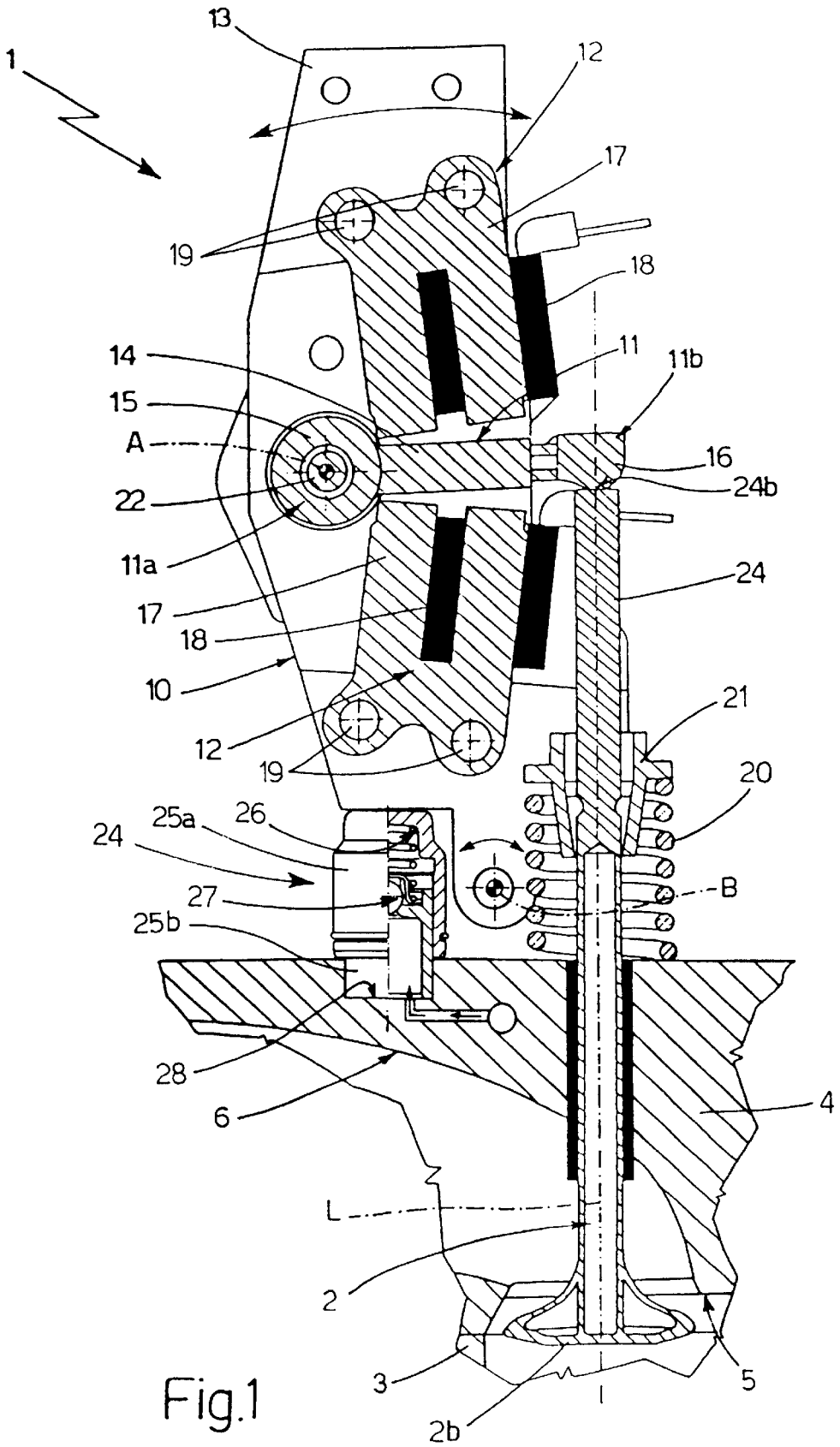
FIG. 1 is a front view, with parts in cross-section and other parts removed for clarity, of an internal combustion engine provided with an electromagnetic actuator for the actuation of the intake and/or exhaust valves according to the present invention.
Figure 2:
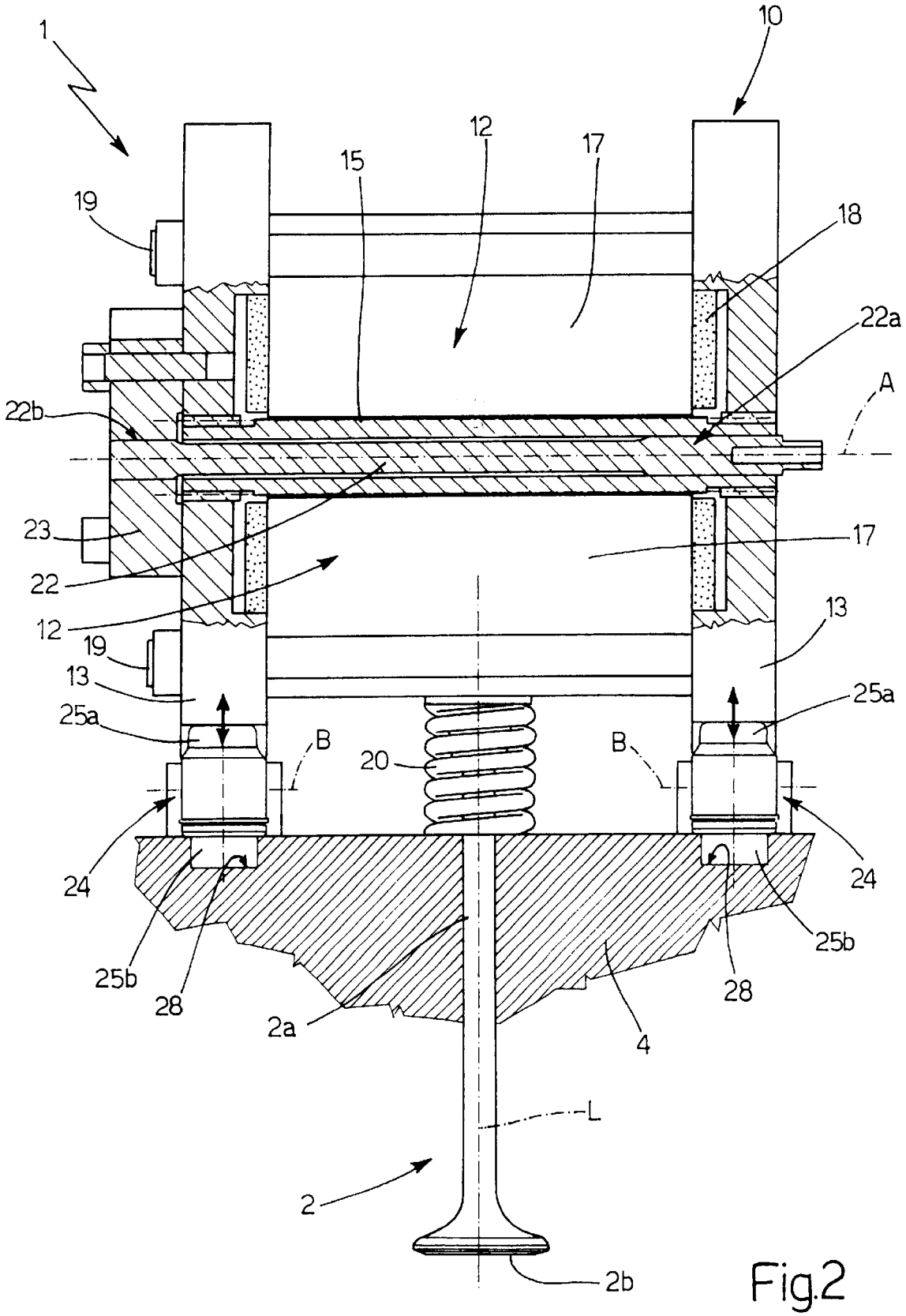
FIG. 2 is a side view, with parts in cross-section and other parts removed for clarity, of the electromagnetic actuator of FIG. 1.

In FIGS. 1 and 2, an electromagnetic actuator adapted to displace, on command, at least one intake or exhaust valve 2 of an internal combustion engine, which normally comprises a base 3, one or more pistons (not shown) mounted in an axially sliding manner within respective cylindrical cavities obtained in the body of the base 3 and a head 4 disposed at the apex of the base 3 in order to close the above-mentioned cylindrical cavities, is shown overall by 1.

Within the respective cylindrical cavity, each piston bounds, together with the head 4, a variable-volume combustion chamber 5, while the head 4 is provided, for each combustion chamber 5, with at least one intake duct and at least one exhaust duct adapted to connect the combustion chamber 5 respectively with the intake manifold and the exhaust manifold of the engine which are both of known type and are not therefore shown.

In FIG. 1, the internal combustion engine is lastly provided with a group of intake and exhaust valves 2 which are respectively adapted to regulate the flow of air into the combustion chamber 5 via the intake duct and the outflow of combusted gases from the combustion chamber 5 via the exhaust duct.

In this case, the internal combustion engine has, at the inlet of each duct, whether it is an intake or exhaust duct, a respective mushroom valve 2 of known type which is mounted on the head 4 of the engine with its stem 2*a* sliding axially through the body of the head 4 and its head 2*b* moving axially at the inlet of the duct, so that it can be moved between a closed position in which the head 2*b* of the valve 2 prevents gases from flowing through the intake or exhaust duct to and from the combustion chamber 5 and a position of maximum opening in which the head 2*b* of the valve 2 allows gases to pass through the intake or exhaust duct to and from the combustion chamber 5 with the maximum admissible flow.

FIG. 1 in particular shows a portion of the head 4 at the location of a combustion chamber 5, the end section of the intake duct relating to this combustion chamber 5 and the intake valve 2 adapted to regulate the passage of air through this intake duct indicated hereafter by reference numeral 6.

In FIGS. 1 and 2, the electromagnetic actuator 1 comprises a support frame 10 hinged on the head 4 of the internal combustion engine as will be described in detail below, an oscillating arm 11 of ferromagnetic material having a first end 11*a* hinged on the support frame 10 so that it can oscillate about an axis of rotation A perpendicular to the longitudinal axis L of the valve 2, and a second end 11*b* disposed directly in abutment on the upper end of the stem 2*a* of the valve 2, and a pair of electromagnets 12 disposed one above the other on opposite sides of the central portion of the oscillating arm 11 in order to be able to attract, on command and alternatively, the oscillating arm 11 by causing it to rotate about the axis of rotation A. According to a preferred embodiment, the oscillating arm 11, or at least a part thereof, is formed by a pack of sheets of ferromagnetic material in order to reduce losses resulting from parasitic currents.

In the embodiment shown, the support frame 10 is formed by a pair of parallel plates 13 facing one another which extend alongside the stem 2*a* of the valve 2 to be axially moved parallel to the longitudinal axis L of the valve 2 and are hinged on the head 4 of the engine so that they may oscillate about an axis of rotation B preferably, but not necessarily, parallel to the axis of rotation A of the oscillating arm 11.

For its part, the oscillating arm 11 is disposed between the plates 13 that form the support frame 10 and is formed by a central plate 14 of ferromagnetic material positioned in the space between the polar heads of the two electromagnets 12, by a cylindrical tubular member 15 rigid with a lateral edge of the central plate 14 and lastly by a projection 16 extending in a projecting manner from the central plate 14 on the side opposite the cylindrical tubular member 15. With particular reference to FIGS. 1 and 2, the cylindrical tubular member 15 extends coaxially to the axis of rotation A, is mounted to rotate on the plates 13 which form the support frame 10 by means of the interposition of roller bearings of known type, and defines the end 11*a* of the oscillating arm 11, while the projection 16 is cam shaped and is disposed directly in abutment on the upper end of the stem 2*a* of the valve 2, defining the end 11*b* of the oscillating arm 11.

The two electromagnets 12 are both disposed between the plates 13 of the frame 10 and each, in the embodiment shown, comprises a U-shaped magnetic core 17 secured to the support frame 10 such that its two polar heads face the central plate 14, and a coil 18 of electrically conducting material keyed on this magnetic core 17.

It should be borne in mind that the magnetic core 17, in order to reduce hysteresis losses, is formed by a pack of sheets of ferromagnetic material held together by locking bolts 19 mounted to pass through the plates 13. With reference to FIGS. 1 and 2, the electromagnetic actuator 1 further comprises two elastic members, one of which is adapted to maintain the valve 2 in the closed position and the other of which is adapted to maintain the oscillating arm 11 in abutment on one of the electromagnets 12, and in particular on that electromagnet 12 against which the oscillating arm 11 would normally come into abutment in order to position the valve 2 in the position of maximum opening.

In this case, the first elastic member of the electromagnetic actuator 1, bearing the reference numeral 20 below, is formed by a helical spring keyed on the stem 2*a* of the valve 2 so as to have its first end in abutment on the head 4 of the engine and its second end in abutment on an abutment flange 21 secured to the stem 2*a* of the valve 2. The second elastic member of the electromagnetic actuator 1, bearing the reference numeral 22 below, is formed, however, in the embodiment shown, by a torsion bar inserted partially inside the cylindrical tubular member 15 in order to have a first end 22*a* angularly rigid with the cylindrical tubular member 15 and a second end 22*b* rigid with one of the plates 13 of the support frame 10 by means of a locking and adjustment member 23 provided thereon.

It should be borne in mind that the two elastic members, i.e. the helical spring 20 and the torsion bar 22, act in opposition to one another and that their elastic constants are selected such as to position, when neither of the electromagnets 12 are being supplied, i.e. they are in condition of equilibrium, the oscillating arm 11 in a rest position in which it is substantially equidistant from the polar heads of the two electromagnets 12 in order to maintain the valve 2 of the engine in an intermediate position between the closed position and the position of maximum opening.

With reference to FIGS. 1 and 2, the electromagnetic actuator 1 lastly comprises a device 24 for orienting the frame adapted to rotate, on command, the frame 10, i.e. the two plates 13, about the axis of rotation B so as to be able to recover the mechanical play between the end 11*b* of the oscillating arm 11, i.e. the cam-shaped projection 16, and the upper end of the stem 2*a* of the valve 2.

In this case, the electromagnetic actuator 1 comprises one or more hydraulic cylinders 24 actuated by compressed oil, which are adapted to cause, on command, the frame 10 to rotate about the axis of rotation B so as to vary the position of the electromagnetic actuator 1 with respect to the head 4 and the valve 2 in order to maintain the mechanical play between the end 11*b* of the oscillating arm 11, i.e. the cam-shaped projection 16, and the upper end of the stem 2*a* of the valve 2, at a predetermined value.

In the embodiment shown, the electromagnetic actuator 1 is in particular provided with two hydraulic cylinders 24 actuated by compressed oil which circulates in the engine lubrication circuit, each of which is adapted to vary the position of a respective plate 13 of the frame 10 with respect to the head 4.

Each hydraulic cylinder 24 is in practice disposed alongside the hinge that connects the corresponding plate 13 to the head 4, with a first end in abutment on the head 4 of the engine and with a second end in abutment on the lateral edge of the plate 13, in order to adjust the position of the plate 13 by varying its axial length. In the embodiment shown, each hydraulic cylinder 24 is formed by two bowls 25*a* and 25*b* of metal material coupled telescopically so as to define a variable-volume chamber 26 adapted to be filled with compressed oil via a one-way valve 27 disposed on the base of the inner bowl 25*b*.

In FIG. 1, the hydraulic cylinders 24 are disposed on the head 4 of the engine with the outer bowl 25*a* having its base in abutment on the plate 13 and the inner bowl 25*b* housed upside-down within a seat 28 obtained on the surface of the head 4. This seat 28 is connected to the lubrication circuit of the engine so that it can be filled with compressed oil circulating in this lubrication circuit.

When the pressure of the engine oil within the seat 28 exceeds a predetermined value, the one-way valve 27 on the base of the inner bowl 25*b* enables the compressed oil to flow into the variable-volume chamber 26, causing the progressive expansion thereof and the consequent distancing of the two bowls 25*a* and 25*b* from one another. The compressed oil from the variable-volume chamber 26 emerges, however, by drawing at the location of the coupling between the two bowls 25*a* and 25*b*.

Figure 5:
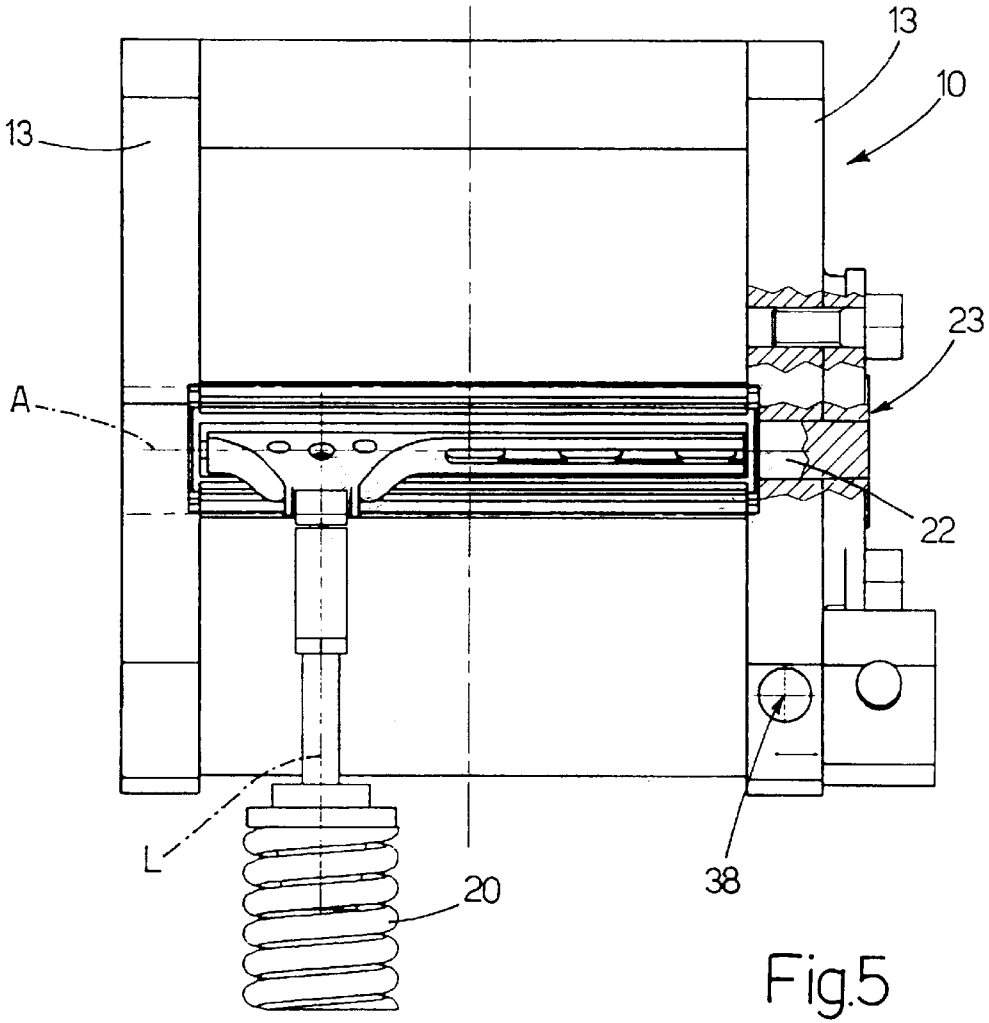
FIG. 5 is a side view, with parts in cross-section and other parts removed for clarity, of the electromagnetic actuator of FIG. 4.
Figure 4:
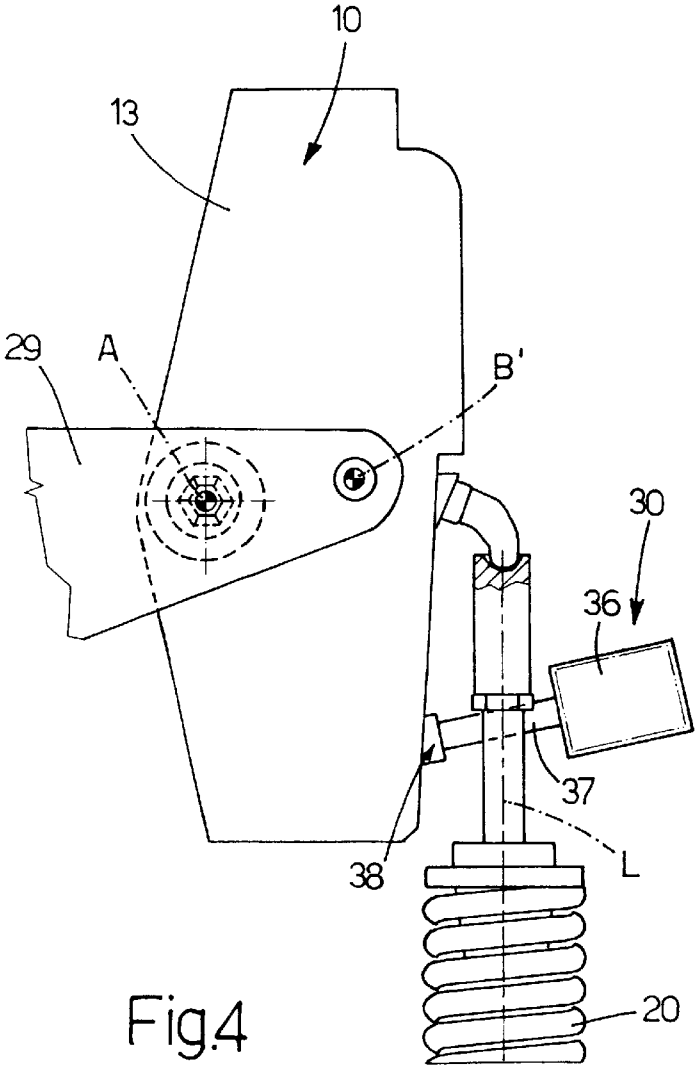
FIG. 4 shows a second variant of the electromagnetic actuator of FIG. 1.
Figure 6:
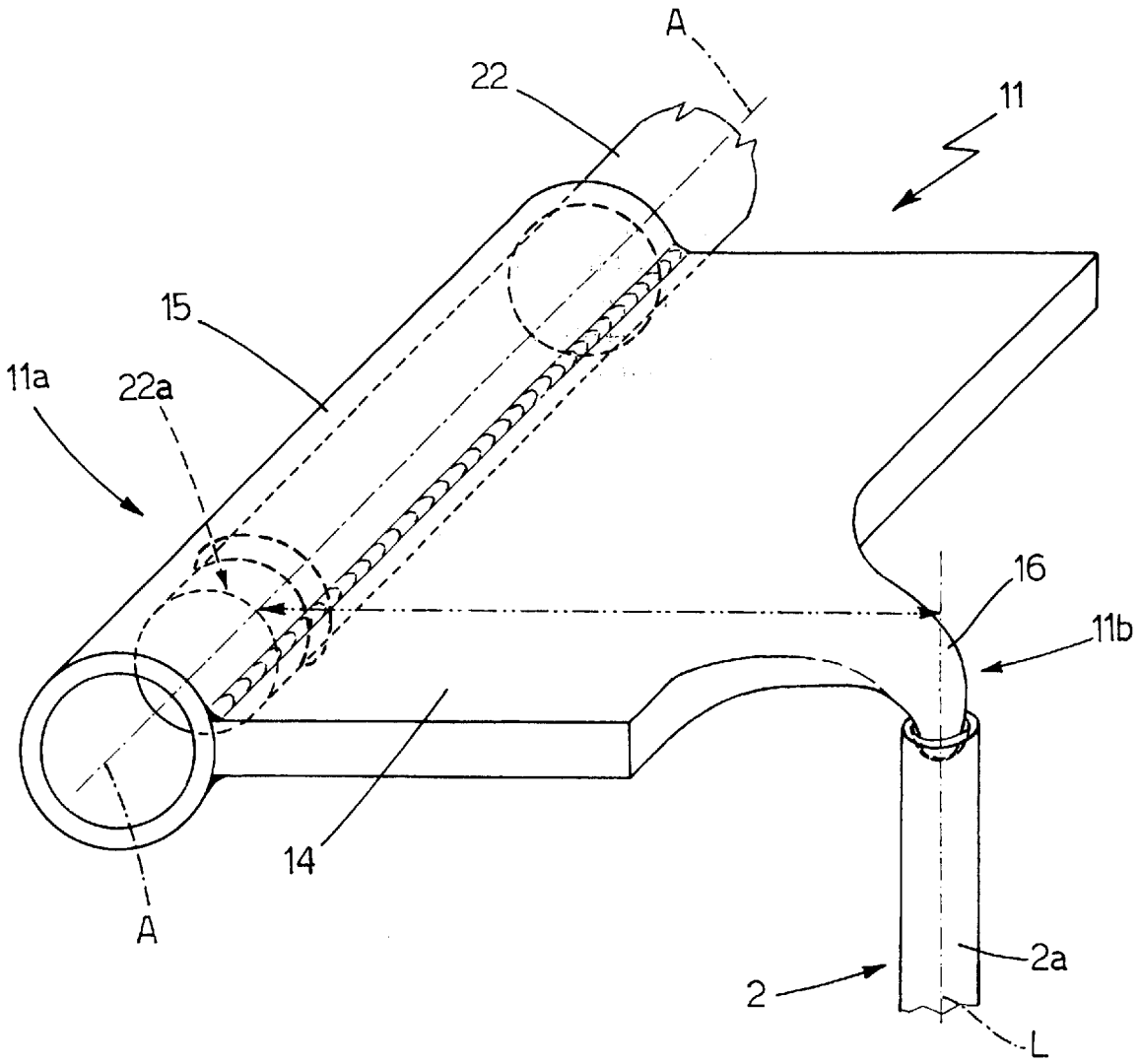
FIG. 6 is a perspective view of a component of the electromagnetic actuator of FIGS. 4 and 5.

According to the variant shown in FIGS. 4, 5 and 6, the frame 10 is hinged on a support member 29 which is in turn secured to the head 4 of the engine.

In further detail, the plates 13 that form the frame 10 are hinged on the support member 29 so as to be able to oscillate about an axis of rotation B' parallel to the axis of rotation A of the oscillating arm 11, in this case under the thrust of a single hydraulic actuator 30 acting directly on the plate 13 that bears the locking and adjustment member 23 of the torsion bar 22. This hydraulic actuator 30 obviously forms the new device for orientating the frame.

With reference to FIG. 4, the hydraulic actuator 30 is a hydraulic actuator of known type, in particular a hydraulic cylinder, which is actuated by compressed oil (for instance the oil circulating in the engine lubrication circuit) and comprises two cylindrical members 36 and 37 coupled telescopically to one another. The cylindrical member 36 is secured (in a known manner which is not therefore shown) to the head 4, while the cylindrical member 37 is in abutment on a support 38 disposed on the lateral edge of the plate 13.

When the hydraulic actuator 30 is supplied with compressed oil (via a non-return valve), the cylindrical member 37 tends to expand axially with respect to the cylindrical member 36 with a predetermined force depending on the oil pressure; if the oil pressure is maintained constant the expansion force of the cylindrical member 36 also remains constant irrespective of the relative position between the two cylindrical members 36 and 37.

In operation, the hydraulic actuator 30 is adapted to exert a constant force F on the plate 13 of the support frame 10, which force tends to cause the frame 10 to rotate about the axis of rotation B' in order to urge the projection 16 against the upper part of the stem 2*a* so as to be able to recover the mechanical play between the end 11*b* of the oscillating arm 11, i.e. the cam-shaped projection 16, and the upper end of the stem 2*a*. In other words, the angular position of the support frame 10 about the axis of rotation B'is automatically adjusted by the hydraulic actuator 30 as a function of the variations of height of the upper end of the stem 2*a* such that the cam-shaped projection 16 of the oscillating arm 11 always remains in contact with the upper end of the stem 2*a* with the force F. The force exerted by the projection 16 of the upper end of the stem 2*a* of the valve 2 is equal to F in static conditions and obviously varies in dynamic conditions.

In this variant, the projection 24 further comprises a hemispherical end portion adapted to engage a corresponding hemispherical seat 32 obtained on the upper end of the stem 2*a* of the valve 2.

With reference to FIG. 6, it should further be noted that in this variant the connection zone between the torsion bar 22 and the cylindrical tubular member 15 of the oscillating arm 11, i.e. the end 22*a* of the torsion bar 22, is disposed substantially in alignment with the projection 16 so as to be disposed in a position of minimum distance with respect to this projection 16. In this way, the mechanical stresses to which the central plate 14 of the oscillating arm 11 are subject are reduced to a minimum as the forces applied to the projection 16 have a substantially zero branch with respect to the connection zone and do not therefore produce torsional couples on the central plate 14.

Figure 3:
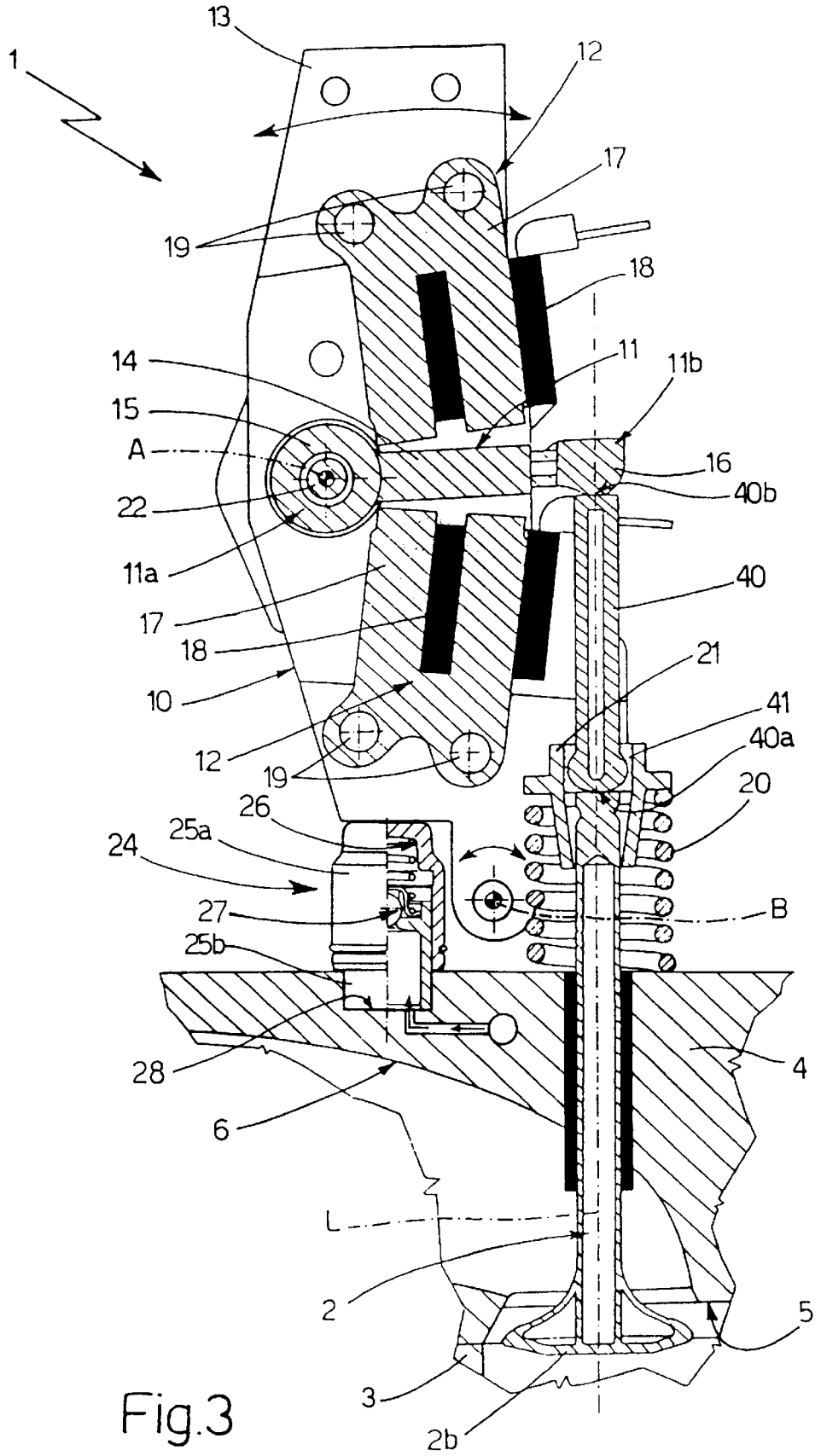
FIG. 3 shows a first variant of the electromagnetic actuator of FIG. 1.

According to the variant shown in FIG. 3, the end 11*b* of the oscillating arm 11, i.e. the cam-shaped projection 16, is disposed in abutment on the upper end of the stem 2*a* of the valve 2 by means of the interposition of a mechanical member adapted to minimise the bending stresses to which the stem 2*a* of the valve 2 is subject during operation.

This mechanical member in this case comprises a strut 40 interposed between the upper end of the stem 2*a* of the valve 2 and the end 11*b* of the oscillating arm 11, and an elastic joint 41 adapted to maintain this strut 40 rigid with the stem 2*a* of the valve 2. The strut 40 is formed by a rod 40 dimensioned to withstand and transfer compression loads that extends coaxially to the stem 2*a* of the valve 2 and has a first end 40*a* in abutment on the upper end of the stem 2*a* of the valve 2, and a second end 40*b* in abutment on the end 11*b* of the oscillating arm 11, while the elastic joint 41 is positioned at the location of the upper end of the stem 2*a* of the valve 2, and is adapted to maintain the rod 40 coaxially to the stem 2*a* of the valve 2, with its end 40*a* always in abutment on the upper end of the stem 2*a* of the valve 2, thereby enabling small oscillations of this rod 40.

As the strut 40 is connected to the stem 2*a* of the valve 2 by means of the elastic joint 41, the mechanical stresses perpendicular to the stem 2*a* of the valve 2, produced by the friction of the end 11*b* of the oscillating arm 11 on the end 40*b* of the strut 40, exclusively produce oscillations of the strut 40 that are damped and are not transmitted to the stem 2*a* of the valve 2.

It should be borne in mind that, in the embodiment shown, the end 40*a* of the strut 40 has a hemispherical shape so as not to impede the oscillations of the strut 40 on the upper end of the stem 2*a* of the valve 2. The rod 40 may further be made in two pieces which are screwed together so that the axial length of the rod 40 can be adjusted in order to regulate the mechanical play.

According to a further variant which is not shown, the electromagnetic actuator 1 does not comprise the helical spring 20 adapted to maintain the valve 2 in the closed position, the upper end of the stem 2*a* of the valve 2 is hinged on the end 11*b* of the oscillating arm 11 and, lastly, the torsion bar 22 is adapted to maintain the valve 2 in a intermediate position between the closed position and the position of maximum opening.

The operation of the electromagnetic actuator 1 can be readily deduced from the above description and illustration: by supplying the two electromagnets 12 alternatively it is possible axially to move the valve 2 between the position of maximum opening, in which the oscillating arm 11 is in abutment on the electromagnet 12 behind the head 6, and the closed position, in which the oscillating arm 11 is in abutment on the upper electromagnet 12. As regards the device 24 for orienting the frame, i.e. the hydraulic cylinders 24, the supply of oil at a pressure higher than the calibration pressure of the one-way valve 27 causes the support frame 10 of the oscillating arm 11 to rotate about the axis of rotation B, so as to recover the mechanical play between the end 11*b* of the oscillating arm 11 and the upper end of the stem 2*a* of the valve 2.

Similar considerations also apply in the case in which the device for orienting the frame is formed by a single hydraulic actuator 30: the supply of compressed oil causes the support frame 10 to rotate about the axis of rotation B', so as to recover the mechanical play between the end 11*b* of the oscillating arm 11 and the upper end of the stem 2*a* of the valve 2.

It will be appreciated that, given the size of the mechanical play in question, the maximum rotation imparted by the hydraulic cylinders 24 or by the hydraulic actuator 30 to the frame 10 is normally lower than one degree. The hydraulic cylinders 24 and the hydraulic actuator 30 are, moreover, provided with an end of stroke in order to limit the possible oscillation of the frame 10 about the axis of rotation B or B' to a predetermined range.

The advantages resulting from the use of the electromagnetic actuator 1 described and illustrated above are evident: by using the device 24 for orienting the frame it is possible to recover the mechanical play between the end 11*b* of the oscillating arm 11 and the upper end of the stem 2*a* of the valve 2, so as to maximise the performance of the electromagnetic actuators for the actuation of the valves.

It is important to bear in mind, moreover, that in the variant shown in FIGS. 4, 5, and 6, the transmission of the force F between the hydraulic actuator 30 and the end 11*b* of the oscillating arm 11 takes place without in any way loading the magnetic cores 17 of the electromagnets 12, as the locking and adjustment member 23 of the torsion bar 22 and the support 38 on which the hydraulic actuator 30 bears are disposed on the same plate 13 of the frame 9. In this way, the force F is transmitted from the hydraulic actuator 30 to the support 38, and then to the plate 13, to the locking and adjustment member 23, and to the torsion bar 22 which supplies it to the oscillating arm 11 from which it reaches the projection 16.

This constructional solution is particularly advantageous as it makes it possible to reduce to a minimum the mechanical stresses present in the magnetic cores 17 and thus prevents the plates of the magnetic cores 17 from being subject to displacements or deformations with respect to their optimum position. These displacements and deformations, as described above, entail an overall increase in the air gaps with consequent increases, which may also be relatively very high, of the magnetising currents circulating in the two electromagnets 12 which are in turn reflected by an increase in the electrical power absorbed.

In operation, the forces applied to the projection 16 during its repetitive interaction with the stem 2*a* of the valve 2 are transmitted to the torsion bar 22 at the location of the connection zone between the torsion bar 22 and the cylindrical tubular member 15 of the oscillating arm 11.

The transmission of these forces takes place by means of the central plate 14 of the oscillating arm 11; as shown in FIG. 6, the connection zone between the torsion bar 22 and the cylindrical tubular member of the oscillating arm 11 is disposed substantially in alignment with the projection 16 so as to be located in a position of minimum distance with respect to this projection 16. In this way, the mechanical stresses to which the central plate 14 of the oscillating arm 11 are subject are reduced to a minimum as the forces applied to the projection 16 have a substantially zero branch with respect to the connection zone and do not therefore produce torsional couples on the central plate 14. This constructional solution is particularly advantageous, as the central plate 14 of the oscillating arm 11 may also be made from a respective pack of sheets which, if subject to relatively high mechanical stresses, may be deformed with a resultant general increase of the air gaps.

It will be appreciated that modifications and variations may be made to the electromagnetic actuator 1 illustrated and described above without thereby departing from the scope of the present invention.

What is claimed is:

1. An electromagnetic actuator (1) for the actuation of valves (2) of an internal combustion engine which comprises: a head (4), at least one variable -volume combustion chamber (5), at least one connection duct (6) adapted to bring the combustion chamber (5) into communication with atmosphere, and at least one valve (2) adapted to regulate the flow of fluids to and from the combustion chamber (5), the valve (2) being mounted in the head (4) so that the valve can move axially between a closed position in which the valve closes off the connection duct (6) and a position of maximum opening in which the valve enables fluids to flow through the connection duct (8, 9) with maximum admissible flow, the electromagnetic actuator (1) being mounted on the head (4) in order to move, on command, the valve (2) between its closed position and its position of maximum opening, and being characterised in that the actuator comprises means for recovering mechanical play (24; 30) between the valve (2) and the actuator (1), and a frame (10) which is connected to the head (4) of the engine so as to be able to oscillate about a first axis of rotation (B, B') substantially perpendicular to the axis of movement (L) of the valve (2), the means for recovering the mechanical play (24; 30) comprising a device for adjusting the position of the frame (24; 30) with respect to the head (4) which is adapted to rotate, on command, the frame (10) about the first axis of rotation (B, B') so as to maintain the mechanical play at a predetermined value said actuator further comprising:

an oscillating arm (11) which has a first end (11*a*) hinged on the frame (10) so as to be able to oscillate about a second axis of rotation (A) parallel to the first of axis of rotation (B) and a second end (11*b*) connected to the valve (2), and a pair of electromagnets (12) adapted to cause the oscillating arm (11) to rotate, on command, in order axially to displace the valve (2) between the closed position and the position of maximum opening, a first elastic member (20) adapted to maintain the valve (2) in the closed position, the second end (11*a*) of the oscillating arm (11) being disposed in abutment on the valve (2) so as to be able to transmit only an axial thrust contrary to that of the first elastic member (20), and a second elastic member (22) adapted to maintain the valve (2) in the position of maximum opening, by exerting on said valve (2) an axial thrust contrary to that of the first elastic member (20), wherein the second elastic member (22) is connected to a bearing member (13) of the frame (10), the device for adjusting the position of the frame (24; 30) acting on said bearing member (13).

2. An electromagnetic actuator as claimed in claim 1, characterised in that the device for adjusting the position of the frame (24; 30) with respect to the head (4) comprises at least one hydraulic cylinder (24; 30) interposed between the frame (10) of the hydraulic actuator (1) and the head (4) of the internal combustion engine.

3. An electromagnetic actuator as claimed in claim 1, characterised in that the first (20) and the second elastic member (22) are adapted to maintain, in a condition of equilibrium, the valve (2) in an intermediate position between the closed position and the position of maximum opening.

4. An electromagnetic actuator as claimed in claim 1, characterised in that the second elastic member (22) acts directly on the oscillating arm (11).

5. An electromagnetic actuator as claimed in claim 1, characterised in that the pair of electromagnets (12) are secured to the frame (10) on opposite sides of the oscillating arm (11).

6. An electromagnetic actuator as claimed in claim 1, characterised in that the second elastic member (22) is formed by a torsion bar (22) having a first end connected to the oscillating arm (11) and a second end connected to the bearing member (13).

7. An electromagnetic actuator as claimed in claim 1, characterised in that the frame (10) comprises two end plates (13) disposed parallel and facing one another, each of which is connected to the head (4) of the engine in order to be able to oscillate about the first axis of rotation (B, B'), the second elastic member (22) being connected to one of the end plates (13) and the device for adjusting the position of the frame (24; 30) being adapted to act only on the end plate (13) to which the second elastic member 22 is connected.

8. An electromagnetic actuator as claimed in claim 7, characterised in that the oscillating arm (11) comprises a projection (16) disposed in abutment on the valve (2), the oscillating arm (11) being connected to the torsion bar (22) in a zone disposed substantially at a minimum distance with respect to said projection (16).

9. An electromagnetic actuator as claimed in claim 1, characterised in that the second end (11*a*) of the oscillating arm (11) is disposed directly in abutment on the valve (2) of the internal combustion engine.

10. An electromagnetic actuator as claimed in claim 1, further comprising a strut (40) interposed between the second end (11*a*) of the oscillating arm (11) and the valve (2) of the internal combustion engine, and an elastic joint (41) adapted to maintain the strut (40) rigid with the valve (2) of the internal combustion engine.

11. An electromagnetic actuator as claimed in claim 10, characterised in that the valve (2) of the internal combustion engine is a mushroom valve mounted with its rod (2*a*) sliding axially through the head (6) of the internal combustion engine, the electromagnetic actuator (1) being adapted to act on the stem (2*a*) of said mushroom valve (2).

12. An electromagnetic actuator as claimed in claim 1, characterised in that the frame (10) is hinged directly on the head (4) of the engine.

13. An electromagnetic actuator as claimed in claim 1, characterised in that the frame (10) is hinged on a support member (29) in turn rigid with the head (4) of the engine.

14. An electromagnetic actuator as claimed in claim 1, wherein said means for recovering the mechanical play is a hydraulic means.

* * * * *

UNITED STATES PATENT AND TRADEMARK OFFICE

CERTIFICATE OF CORRECTION

PATENT NO. : 6,546,904 B2
DATED : April 15, 2003
INVENTOR(S) : Marchioni et al.

It is certified that error appears in the above-identified patent and that said Letters Patent is hereby corrected as shown below:

Title page,
Item [73], Assignee, delete "Magnetic Marelli S.p.A., Milan (IT)" and substitute therefor -- Magneti Marelli S.p.A., Milan (IT) --

Signed and Sealed this

Nineteenth Day of August, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,546,904 B2
DATED : April 15, 2003
INVENTOR(S) : Marchioni et al.

It is certified that error appears in the above-identified patent and that said Letters Patent is hereby corrected as shown below:

Title page,
Item [30], Foreign Application Priority Data, delete
"March 9, 2000 BO200A127" and substitute therefor
-- March 9, 2000 BO2000A000127 --

Signed and Sealed this

Twenty-third Day of December, 2003

JAMES E. ROGAN
*Director of the United States Patent and Trademark Office*